US007097540B1

(12) United States Patent
Gosinski et al.

(10) Patent No.: US 7,097,540 B1
(45) Date of Patent: Aug. 29, 2006

(54) METHODS AND APPARATUS FOR MACHINING FORMED PARTS TO OBTAIN A DESIRED PROFILE

(75) Inventors: Philip John Gosinski, Rutland, VT (US); Mark Stephen Krautheim, Orwell, VT (US); Kendra Lyn Anderson, West Rutland, VT (US); Carl Grant, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 40 days.

(21) Appl. No.: 11/138,201

(22) Filed: May 26, 2005

(51) Int. Cl.
*B24B 1/00* (2006.01)

(52) U.S. Cl. ..... 451/8; 451/5; 451/41; 29/558

(58) Field of Classification Search ..... 451/5, 451/8, 41; 164/516
See application file for complete search history.

(56) References Cited

U.S. PATENT DOCUMENTS

| | | | | |
|---|---|---|---|---|
| 2,796,215 | A * | 6/1957 | Warnken | 416/230 |
| 3,909,600 | A | 9/1975 | Hohn | |
| 3,988,913 | A | 11/1976 | Metcalfe et al. | |
| 4,623,971 | A | 11/1986 | Ailman et al. | |
| 4,646,251 | A * | 2/1987 | Hayes et al. | 345/423 |
| 4,835,710 | A | 5/1989 | Schnelle et al. | |
| 4,972,347 | A | 11/1990 | Tarvin et al. | |
| 5,187,967 | A | 2/1993 | Singh et al. | |
| 5,465,780 | A * | 11/1995 | Muntner et al. | 164/516 |
| 5,557,719 | A | 9/1996 | Ooka et al. | |
| 5,664,085 | A | 9/1997 | Morito | |
| 6,018,860 | A * | 2/2000 | Smith et al. | 29/558 |
| 6,612,811 | B1 | 9/2003 | Morgan et al. | |
| 6,684,742 | B1 | 2/2004 | White | |
| 2005/0115297 | A1 | 6/2005 | DeMichele et al. | |

FOREIGN PATENT DOCUMENTS

WO WO 03/004197 A1 1/2003

* cited by examiner

*Primary Examiner*—Lee D. Wilson
*Assistant Examiner*—Anthony Ojini
(74) *Attorney, Agent, or Firm*—William Scott Andes; Armstrong Teasdale LLP

(57) ABSTRACT

A multiple pass machining method for removing excess flash from a formed part to approximate a desired, curved profile on the formed part includes moving the part relative to a grinder in p straight passes, wherein a first pass removes a portion of flash is at an angle E relative to a stack axis of the part and each remaining straight pass is at an incremental angle F. A portion of the flash is thereby removed to approximate a master profile on an abraded edge of the part.

20 Claims, 2 Drawing Sheets

METHODS AND APPARATUS FOR MACHINING FORMED PARTS TO OBTAIN A DESIRED PROFILE

BACKGROUND OF THE INVENTION

This invention relates generally to manufacturing of parts having a curved profile, and more particularly to methods and apparatus for machining formed parts that are particularly suited, but not limited to, the manufacturing of airfoils.

An airfoil chord and length trimming operation is performed during manufacturing of compressor blades or vanes. This process produces square burred edge shapes that are aerodynamically unacceptable. The leading edge shape of the airfoil is formed in a secondary operation to produce a radiused leading edge that is aerodynamically acceptable. Acceptability of the leading edge shape is determined by comparing the shape of the airfoil leading edge shape against a predetermined required aerodynamic shape in the form of a reticule. Reticules are created for each required inspection section from an aerodynamic glass master. There is an applicable machining tolerance that allows variation in accordance with the capability of the process.

At least two known methods are currently used to produce leading edge aerodynamic profiles. The first method is a manual operation in which an operator holds onto the part and presses the airfoil edge against a rotating abrasive wheel or belt while moving it through a series of motions to generate the correct edge shape. Edges are then tumbled in an abrasive medium for further rounding. Disadvantages of this method include variability in the consistency of the edge profile and the time required to perform the task, both of which depend upon the skill level of the operator.

A second known method effectively replaces the operator in the first method with a six-axis machine or robot, which is also used in conjunction with a secondary tumble process in an abrasive medium. Multiple passes have been necessary to remove sufficient material before the secondary tumble process can be used to produce the required aerodynamic shape, because satisfactory approximations have not been available to generate sufficiently accurate edge profiles.

BRIEF DESCRIPTION OF THE INVENTION

There is therefore provided, in one aspect of the present invention, a multiple pass machining method for removing excess flash from a formed part to approximate a desired, curved profile on the formed part. The method includes moving the part relative to a grinder in p straight passes, wherein a first pass removes a portion of flash is at an angle E relative to a stack axis of the part and each remaining straight pass is at an incremental angle F. A portion of the flash is thereby removed to approximate a master profile on an abraded edge of the part.

In another aspect, the present invention provides a formed part having flash along at least one edge ground away in a plurality of passes to approximate a curved profile, wherein the approximation includes a plurality of ground-away straight lines corresponding to angles E+(n−1)F, where n ranges from 1 to p, and p is an integer greater than or equal to 2.

In yet another aspect, the present invention provides a multiple pass machining method for removing excess flash from a formed part to produce a desired profile on the formed part. The method includes (a) selecting a first line tangent to a master profile of the formed part, that intersects a flash curve. (b) At an intersection of line A and the flash curve, selecting a line B tangent to the flash curve. (c) Measuring an angle C between lines A and B. (d) Adjusting line A in accordance with a desired shape tolerance. (e) Measuring an included angle D between a trimmed edge of the formed part and the adjusted line A. (f) Determining a first pass angle E as a product of angle D and a preselected first pass factor $\alpha$. (g) Determining subsequent pass angles F in accordance with a difference between angles D and E and a total number of passes. (h) Positioning an edge of the part relative to an abrasive and use the abrasive to remove portions of the excess flash in accordance with determined angles E and F to thereby approximate the master profile on the abraded edge of the part.

Upon gaining an understanding of the present invention, it will be appreciated that configurations of the present invention provide accurate shaping of edges of formed parts in a particularly efficient manner.

DETAILED DESCRIPTION OF THE INVENTION

A technical effect of some configurations of the present invention is the production of formed parts, for example, airfoils, of particular shapes to within strict tolerances. Also, as used herein, a "formed" part is a part formed with flash. Example of "formed" parts include, but are not limited to, parts that are forged, rolled, or hydroformed with flash. However, as used herein, a "formed" part is intended to refer to a part produced by any process that produces flash unless otherwise explicitly indicated.

Figure 1:
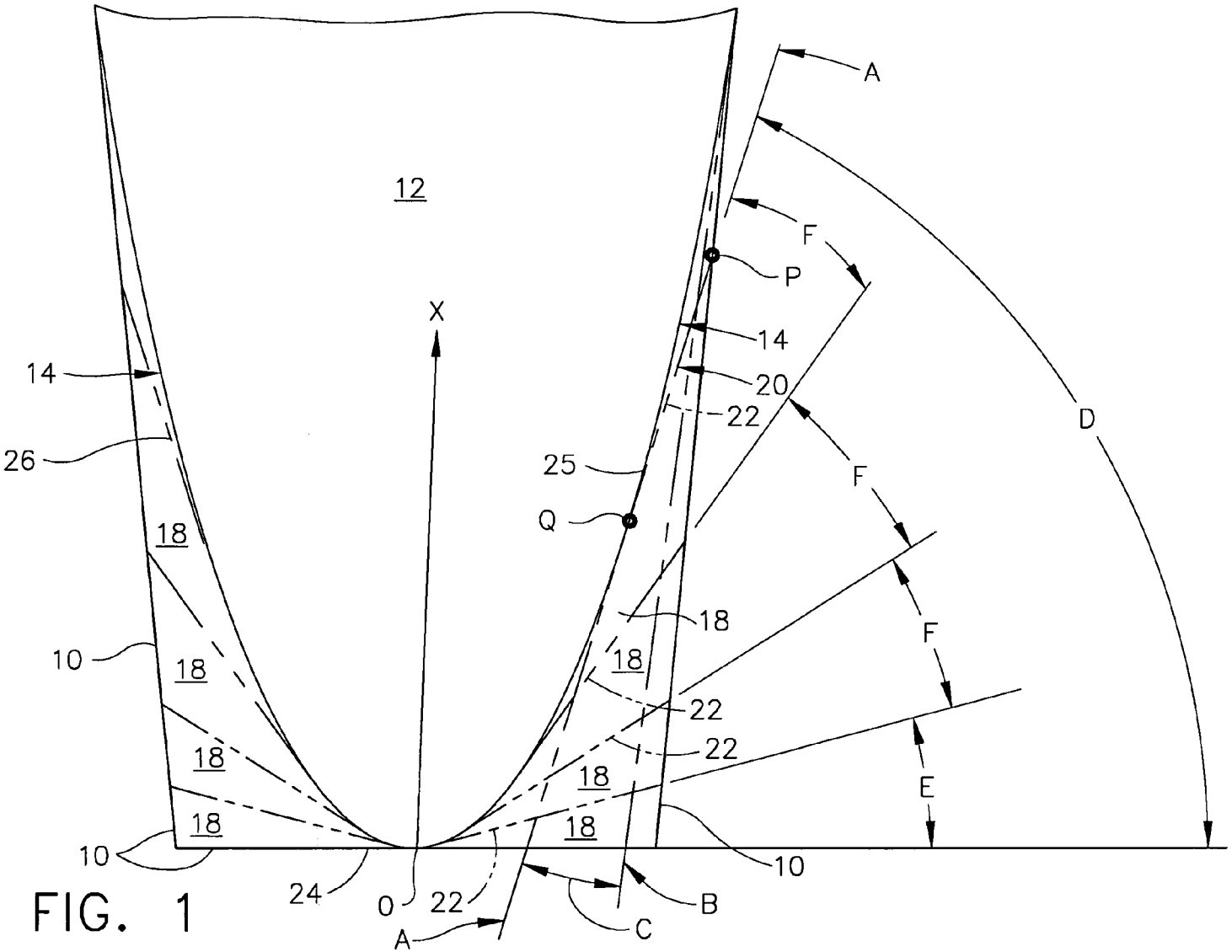
FIG. 1 is a geometric diagram illustrating a formed airfoil with excess flash, as well as various points, lines, and angles that are used to geometrically determine angles of cuts used to remove excess flash.

In some configurations of the present invention and referring to FIG. 1, a multiple pass machining method for removing excess flash 10 from a formed part 12 to approximate a desired, curved master profile 14 on the formed part, for example, an airfoil, is provided. The method includes moving part 12 relative to a grinder 16 (see FIG. 2) in p straight passes, wherein a first pass to remove a portion of flash 18 is at an angle E relative to a stack axis X of part 12 and each remaining straight pass is at an incremental angle F so that excess flash 10 is removed. An abraded edge 20 is left with straight facets 22 in flash 18 that approximate a desired master profile 14. In many configurations, straight facets 22 are essentially tangent to curved master profile 14 and leave only a tiny portion of flash 18 on formed part 12, so the approximation to the desired, curved master profile 14 is extremely close.

In some configurations, formed part 12 is manufactured so that the initial flash 18 is in a parabolic shape. An edge 24 is then trimmed that is essentially tangent to a tip of part 12 at stack axis X. Edge 24 is not necessarily perpendicular to stack axis X. Profile 14 is approximated by abrading parabolic initial flash 18. In many configurations, a similar method is employed to abrade both a concave edge 25 of part 12 and a convex side 26.

For example, in some configurations and referring again to FIG. 1, a tangent line A is selected that is tangent to curved master profile 14. Tangent A intersects the flash at a point P more distant from trimmed edge 24 than tangent point Q of tangent line A. Another tangent line B is then selected. Tangent line B is tangent to flash 18 at point P. Tangent line A and tangent line B (hereinafter, "tangent A" or "line A" and "tangent B" or "line B") form an angle C that is then determined. In some configurations, a maximum and/or a desired value of angle C is set in accordance with a manufacturing tolerance. In many configurations, a desirable measure for angle C is between about 4 and a maximum of about 12 degrees. Larger values of angle C result in higher deviations from curved master profile 14, whereas lower values result in less deviation. However, very small angles C require a larger number of straight line passes to generate an approximation to curved master profile 14 than do larger angles C. In at least one configuration, an angle C equal to about 6 degrees is sought to acceptably balance the tradeoff between the number of passes and the accuracy to which curved master profile 14 is approximated. In other configurations, angle C may be either smaller or greater than 6 degrees. With the selected tangent A and the determined tangent B, angle C may not necessarily fall within a preselected range (e.g., a range such as 4 to 12 degrees, or within a preselected tolerance of a particular value, such as 6 degrees). Thus, in some configurations, another tangent A is selected and another tangent B is determined (i.e., line A and line B are "adjusted") and the process repeated until angle C is within the preselected range. Some configurations use a Newton-Raphson method to closely approach a preselected value of angle C until the angle C that results is within a preselected tolerance range.

When an acceptable value of angle C is reached, an included angle D is measured or otherwise determined between trimmed edge 24 and the final tangent A. A first pass angle E is determined as $E=\alpha D$, where $\alpha$ is a preselected first pass factor. The preselected first pass factor in some configurations is between 0.2 and 0.5. As a rule of thumb, the preselected first pass factor can be (and is in some configurations) set equal to 1/p, where p is a preselected number of passes to move part 12 relative to an abrasive grinding wheel (for example) to generate profile 14. An angle F is then determined as $F=(D-E)/(p-1)$. With these angles determined, part 12 is then moved relative to a grinder in p straight passes in accordance with angles E and F so that a portion of flash 18 (i.e., excess flash 10) is removed to approximate master profile 14 on the abraded edge (shown in FIG. 1 as profile 14). In some configurations, each straight pass starts from a point at which a robot drives part 12 to a grinding wheel, which can be (and is in some configurations) an intersection of each tangent line with curve 25 or 26. Each pass n is at an angle $E+(n-1)F$, where n ranges from 1 to p, and p is an integer greater than or equal to 2, or, in some configurations, p is an integer between 3 and 5. In general, the apex of angles E and F are not at origin O, where the x-axis meets line 24, although the scale of FIG. 1 is not large enough to show this for all of the angles. However, the scale is large enough to show that the last pass for the configuration represented in FIG. 1 starts at point Q and does not end at origin O.

In some configurations, the selection of line A, line B, the measurement of angle C between lines A and B, and the adjustment of line A in accordance with a desired shape tolerance are iterated until the desired shape tolerance is met. The criteria for meeting the desired shape tolerance can be either the size of angle C, as indicated above. However, the meeting of the desired shape tolerance can be determined in some configurations by the actual machining of a part after the determination of pass angles E and F. In either case, at least the selection of line A, line B, the measurement of angle C between lines A and B, and the adjustment of line A in accordance with a desired shape tolerance are iterated until the desired shape tolerance is met. (In the latter case, additional steps are also performed.)

Figure 2:
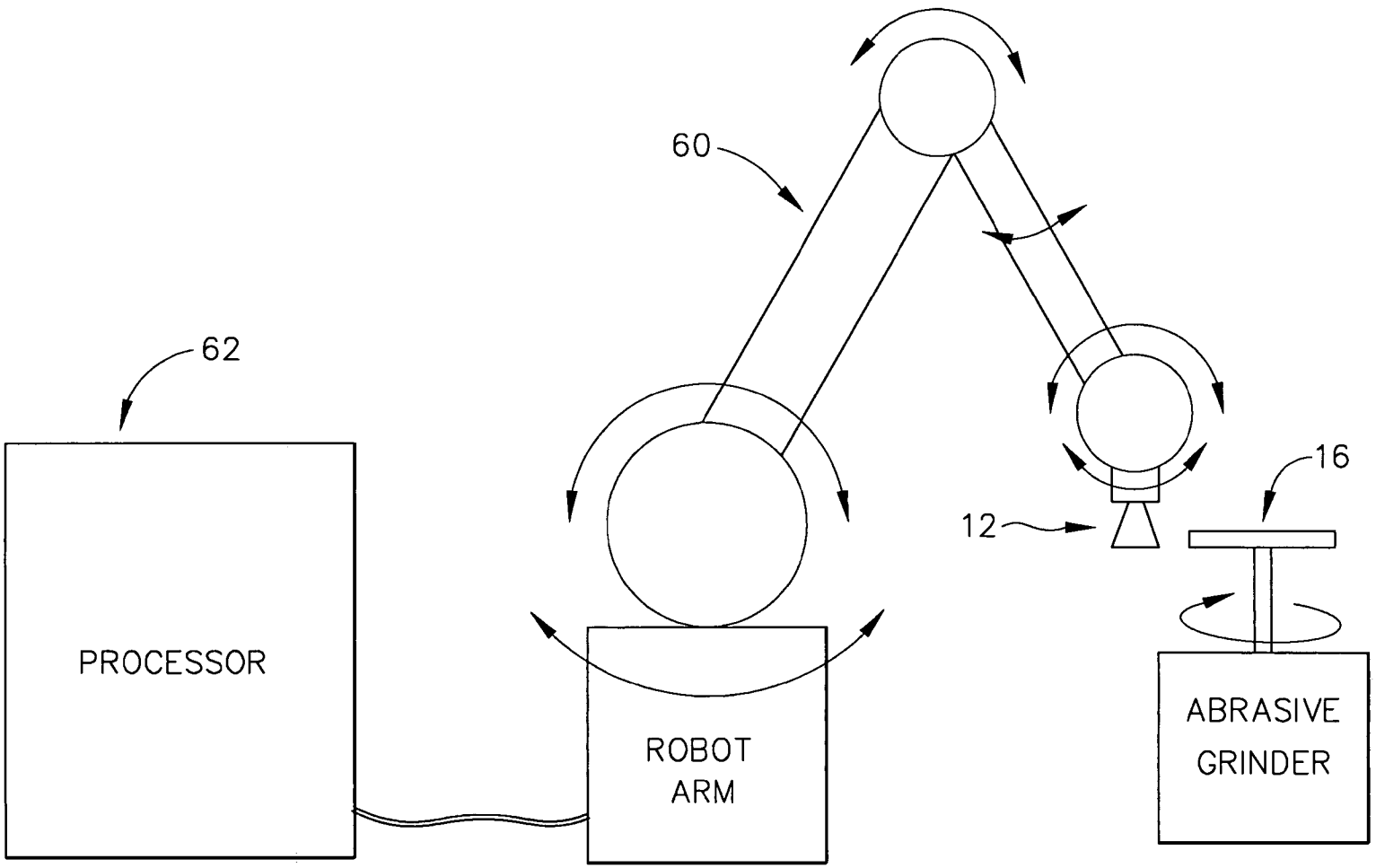
FIG. 2 is a pictorial schematic drawing representing the grinding of the formed airfoil of FIG. 1 on a grinding wheel using a 6-axis robot arm.

In some configurations and referring to FIG. 2, a 6-axis robot 60 is used to hold part 12 and to move it past an abrasive grinding wheel. Angles E and F are used to program the robot to define how part 12 will be moved against a rotating, abrasive wheel, which is positioned at a stationary location.

In many instances, an equation for excess flash 18 and for master profile 14 is available for each side of part 12, for each section taken through part 12. These equations can be made directly available or they can be determined as necessary by fitting sets of points, e.g., one set of points for the flash and for the master profile for the convex side, and two similar sets of points for the concave side. Each set of points is two-dimensional, but because part 12 is three-dimensional, several sections are stacked to make the 3D shape of each side of part 12. So the user has an equation for the airfoil shape and an equation for the curve that is labeled "flash."

During the design of forging dies, allowance is made in the design to generate flash 18, i.e., the excess material that flows out of the dies when a part 12 is formed. The shape of excess flash 18 can be determined and can be made consistent for each formed part from the dies. In some configurations of the present invention, information concerning the shape of flash 18 is known. However, in some configurations, only a set of points is available, and the points are fitted by a user to an equation that is empirically determined for each application and which is not extremely critical.

Thus, four equations are used, one for the concave side of part 12 and another for the convex side of part 12, and equations for the excess flash 18 on each side, as well.

Since the user knows the equation for flash 18 and the airfoil 12 sheet, a user can readily determine tangent lines A and B in accordance with on the known equations. Maximum tolerances of 0.01 in (0.254 mm) are readily obtained, and more exact tolerances are possible. A computer (not shown in the Figures) can be used to aid in calculations based upon the equations, including the determination of tangent lines and the various angles. Results can be programmed into a computer or processor 62 to numerically control robot 60. Once appropriate angles E and F are determined for one part 12, it is no longer necessary in many configurations of the present invention to perform the steps to determine these for other similar parts 12, provided that tolerances in the forging process are sufficient to allow the dimensions of part 12 and flash 10 to be sufficiently repeatable.

It will thus be appreciated that configurations of the present invention provide accurate shaping of edges of formed parts in a particularly efficient manner.

While the invention has been described in terms of various specific embodiments, those skilled in the art will recognize that the invention can be practiced with modification within the spirit and scope of the claims.

What is claimed is:

1. A multiple pass machining method for removing excess flash from a formed part to approximate a desired, curved profile on the formed part, said method comprising: moving the part relative to a grinder in p straight passes, wherein a first said straight pass to remove a portion of flash is at an angle E relative to a stack axis of the part and each remaining said straight pass is at an incremental angle F so that a portion of the flash is removed to thereby approximate a master profile on an abraded edge of the part.

2. A method in accordance with claim 1 wherein the part is an airfoil.

3. A method in accordance with claim 2 further comprising manufacturing the airfoil with a parabolic flash and a trimmed edge, and the profile is approximated by abrading the parabolic flash.

4. A method in accordance with claim 3 performed on a convex side of the airfoil and again on a concave side of the airfoil, not necessarily using the same p, E, and F on the convex side and on the concave side.

5. A method in accordance with claim 3 further comprising:

until an angle C between a selected tangent A and a determined tangent B is within a preselected range, selecting a tangent A to the desired profile, determining a tangent B to the flash at the intersection point of tangent A with the flash, and determining angle C between tangents A and B;

measuring or otherwise determining an included angle D between a trimmed edge of the formed part and a final said selected tangent A;

determining a first pass angle E as $E=\alpha D$, where $\alpha$ is a preselected first pass factor;

determining an angle F as $F=(D-E)/(p-1)$, where p is a preselected number of passes to generate the profile; and wherein moving the part relative to a grinder in p straight passes comprises moving the part relative to an abrasive grinder in p straight passes so that a portion of the flash in accordance with determined angles E and F is removed to thereby approximate the master profile on an abraded edge of the part.

6. A method in accordance with claim 5 wherein the preselected range of angle C is between 4 degrees and 12 degrees.

7. A method in accordance with claim 5 wherein said selecting a tangent A to the desired profile, determining a tangent B to the flash at the intersection point of tangent A with the flash, and determining angle C between tangents A and B until the angle C between tangent A and tangent B is within a preselected range further comprises selecting tangent A in accordance with a Newton-Raphson technique to approach a preselected value of angle C.

8. A method in accordance with claim 7 wherein the preselected angle is 6 degrees.

9. A method in accordance with claim 5 wherein a is between 0.2 and 0.5.

10. A method in accordance with claim 5 wherein $\alpha=1/p$.

11. A method in accordance with claim 5 wherein said wherein moving the part relative to a grinder in p straight passes further comprises programming a 6 axis robot in accordance with angles E and F to move the part in a straight line against a stationary abrasive wheel.

12. A formed part having flash along at least one edge ground away in a plurality of passes to approximate a curved profile, wherein said approximation comprises a plurality of ground-away straight lines, corresponding to angles $E+(n-1)F$, where n ranges from 1 to p, where p is an integer greater than or equal to 2.

13. A formed part in accordance with claim 12 wherein the formed part is an airfoil.

14. A formed part in accordance with claim 13 having at least two edges ground away in a plurality of passes to approximate curved profiles, wherein one of said edges is convex and the other said edge is concave.

15. A formed part in accordance with claim 13 wherein said approximation comprises between 3 and 5 straight lines.

16. A multiple pass machining method for removing excess flash from a formed part to produce a desired profile on the formed part, said method comprising:

(a) selecting a first line A tangent to a master profile of the formed part, that intersects a flash curve;

(b) at an intersection of line A and the flash curve, selecting a line B tangent to the flash curve;

(c) measuring an angle C between lines A and B;

(d) adjusting line A in accordance with a desired shape tolerance;

(e) measuring an included angle D between a trimmed edge of the formed part and the adjusted line A;

(f) determining a first pass angle E as a product of angle D and a preselected first pass factor $\alpha$;

(g) determining subsequent pass angles F in accordance with a difference between angles D and E and a total number of passes; and (h) positioning an edge of the part relative to an abrasive and use the abrasive to remove portions of the excess flash in accordance with determined angles E and F to thereby approximate the master profile on the abraded edge of the part.

17. A method in accordance with claim 16 wherein said positioning an edge of the part relative to an abrasive comprises programming a robot to move the part relative to an abrasive grinder.

18. A method in accordance with claim 17 wherein $\alpha=1/p$, where p is a preselected number of passes to move the part relative to the abrasive grinder to generate the profile.

19. A method in accordance with claim 16 wherein $\alpha$ is between 0.2 and 0.5.

20. A method in accordance with claim 16 further comprising repeating steps (a)–(d) until the desired shape tolerance is met.

* * * * *

UNITED STATES PATENT AND TRADEMARK OFFICE

CERTIFICATE OF CORRECTION

PATENT NO. : 7,097,540 B1
APPLICATION NO. : 11/138201
DATED : August 29, 2006
INVENTOR(S) : Gosinski et al.

It is certified that error appears in the above-identified patent and that said Letters Patent is hereby corrected as shown below:

In Claim 9, column 5, line 48, delete "wherein a is" and insert therefor -- wherein $\alpha$ is --.

In Claim 18, column 6, line 45, delete "wherein $\alpha$ = =1/p" and insert therefor -- wherein $\alpha$ =1/p --.

Signed and Sealed this

Twentieth Day of November, 2007

JON W. DUDAS
*Director of the United States Patent and Trademark Office*